US007931941B1

(12) United States Patent
Mastropietro et al.

(10) Patent No.: US 7,931,941 B1
(45) Date of Patent: Apr. 26, 2011

(54) SYNTHESIS OF METALLIC NANOPARTICLE DISPERSIONS CAPABLE OF SINTERING AT LOW TEMPERATURES

(75) Inventors: Michael A. Mastropietro, Bridgewater, NJ (US); Gregory A. Jablonski, Yardley, PA (US)

(73) Assignee: PCHEM Associates, Inc., Monmouth Junction, NJ (US)

( * ) Notice: Subject to any disclaimer, the term of this patent is extended or adjusted under 35 U.S.C. 154(b) by 895 days.

(21) Appl. No.: 11/261,313

(22) Filed: Oct. 29, 2005

Related U.S. Application Data

(60) Provisional application No. 60/623,728, filed on Oct. 29, 2004.

(51) Int. Cl.
*B05D 3/02* (2006.01)
*B22F 1/00* (2006.01)

(52) U.S. Cl. ..... 427/376.6; 75/351; 75/371

(58) Field of Classification Search ..... 427/376.6; 75/351, 371
See application file for complete search history.

(56) References Cited

U.S. PATENT DOCUMENTS

| | | | | |
|---|---|---|---|---|
| 4,456,474 | A | 6/1984 | Jost | 75/0.5 A |
| 4,599,277 | A | 7/1986 | Brownlow et al. | 428/552 |
| 5,071,826 | A | 12/1991 | Anderson et al. | 505/1 |
| 5,292,359 | A * | 3/1994 | Jeng-Shyong et al. | 75/351 |
| 5,332,646 | A | 7/1994 | Wright et al. | 430/137 |
| 5,338,507 | A | 8/1994 | Anderson et al. | 505/470 |
| 5,376,038 | A | 12/1994 | Arad et al. | 446/297 |
| 5,455,749 | A | 10/1995 | Ferber | 362/103 |
| 5,478,240 | A | 12/1995 | Cogliano | 434/327 |
| 5,514,202 | A * | 5/1996 | Lin et al. | 75/351 |
| 5,944,533 | A | 8/1999 | Wood | 434/322 |
| 5,973,420 | A | 10/1999 | Kaiserman et al. | 307/139 |
| 6,036,889 | A | 3/2000 | Kydd | 252/512 |
| 6,103,868 | A | 8/2000 | Heath et al. | 528/482 |
| 6,311,350 | B1 | 11/2001 | Kaiserman et al. | 5/639 |
| 6,353,168 | B1 | 3/2002 | Sosoka, Jr. | 84/600 |
| 6,379,745 | B1 | 4/2002 | Kydd et al. | 427/98.4 |
| 6,645,444 | B2 | 11/2003 | Goldstein | 423/1 |
| 6,660,058 | B1 | 12/2003 | Oh et al. | 75/351 |
| 6,773,926 | B1 | 8/2004 | Freund et al. | 436/149 |
| 6,830,778 | B1 | 12/2004 | Schulz et al. | 427/123 |
| 6,855,378 | B1 | 2/2005 | Narang | 427/553 |
| 6,872,645 | B2 | 3/2005 | Duan et al. | 438/584 |
| 6,878,184 | B1 | 4/2005 | Rockenberger et al. | 75/343 |
| 6,882,824 | B2 | 4/2005 | Wood | 434/308 |
| 6,951,666 | B2 | 10/2005 | Kodas et al. | 427/376.6 |
| 7,115,218 | B2 | 10/2006 | Kydd et al. | 252/512 |
| 2002/0151004 | A1 * | 10/2002 | Craig | 435/173.1 |
| 2002/0193784 | A1 * | 12/2002 | McHale et al. | 606/27 |
| 2003/0008145 | A1 * | 1/2003 | Goldstein | 428/403 |
| 2003/0148024 | A1 * | 8/2003 | Kodas et al. | 427/125 |
| 2003/0224162 | A1 * | 12/2003 | Hirai et al. | 428/402 |
| 2004/0151893 | A1 | 8/2004 | Kydd et al. | 428/323 |
| 2004/0185238 | A1 * | 9/2004 | Kawamura et al. | 428/221 |
| 2005/0078158 | A1 | 4/2005 | Magdassi et al. | 347/100 |
| 2006/0001726 | A1 | 1/2006 | Kodas et al. | 347/105 |
| 2006/0044382 | A1 | 3/2006 | Guan et al. | 347/105 |
| 2006/0163744 | A1 | 7/2006 | Vanheusden et al. | 257/773 |
| 2006/0189113 | A1 | 8/2006 | Vanheusden et al. | 438/597 |

FOREIGN PATENT DOCUMENTS

| | | |
|---|---|---|
| JP | 2003-308499 A | 10/2003 |
| JP | 2003-309337 A | 10/2003 |
| JP | 2003-309352 A | 10/2003 |

OTHER PUBLICATIONS

Internet Archive Wayback Machine webcontent stored on Oct. 15, 2004, retrieved from: http://web.archive.org/web/20041015081534/nano.gov/html/facts/faqs.html (3pgs).*

U.S. Appl. No. 11/613,136, filed Dec. 19, 2006, Jablonski et al.

*ASM Handbook vol. 7: Powder Metal Technologies and Applications*, eds. Eisen, W.B. et al., Published by American Society of Metals, 1998, pp. 360-361.

Bunge, S.D. et al., "Synthesis of Coinage-Metal Nanoparticles from Mesityl Precursors," *Nano. Letters*, 2003, 3(7), 901-905.

Chen, S. et al., "Quantized Capacitance Charging of Monolayer-Protected Au Clusters," *J. Phys. Chem. B*, 1998, 102, 9898-9907.

Curtis, A. C. et al., "A Morphology-Selective Copper Organosol," *Angew. Chem. Int. Ed. Engl.*, 1988, 27(11), 1530-1533.

Curtis, C. et al., "Metallizations by Direct-Write Inkjet Printing," Conf. paper NREL/CP-520-31020, NCPV program review meeting Oct. 14-17, 2001, Lakewood, Colorado, 6 pages.

Curtis, C. J. et al., "Multi-layer Inkjet printed Contacts for Silicon Solar Cells," Conf. paper NREL/CP-520-39902, *2006 IEEE 4th World Conf on Photovoltaic Energy Conversion* (*WCPEC-4*), May 7-12, 2006, Waikoloa, Hawaii, 5 pages.

Esumi, K. et al., "Role of Poly(amidoamine) Dendrimers for Preparing Nanoparticles of Gold, Platinum, and Silver," *Langmuir*, 2000, 16, 2604-2608.

Fuller, S. B. et al., "Ink-Jet Printed Nanoparticle Microelectromechanical Systems," *Journal of Microelectromechanical Systems*, Feb. 2002, 11(1), 54-60.

Haes, A.J. et al., "A Nanoscale Optical Biosensor: Sensitivity and Selectivity of an Approach Based on the Localized Surface Plasmon Resonance Spectroscopy of Triangular Silver Nanoparticles," *J. Am. Chem. Soc.*, 2002, 124 , 10596-10604.

(Continued)

*Primary Examiner* — Timothy H Meeks
*Assistant Examiner* — Nathan H Empie
(74) *Attorney, Agent, or Firm* — Cantor Colburn LLP

(57) ABSTRACT

A process is described for the synthesis of metallic nanoparticles by chemical reduction of metal salts in the presence of organic ligands capable of binding to the metal particle surfaces and stabilizing them against agglomeration. The resultant nanoparticles or dispersions of the particles can be sintered into highly conductive films or traces at temperatures as low as 80° C. in 10 minutes or less.

17 Claims, No Drawings

OTHER PUBLICATIONS

Harfenist, S.A. et al., "Highly Oriented Molecular Ag Nanocrystal Arrays," *J. Phys. Chem.*, 1996, 100, 13904-13910.
Hirai, H. et al., "Preparation of Nonaqueous Dispersion of Colloidal Silver by Phase Transfer," *Chemistry Letters*, 1992, 1527-1530.
Hirai, H., "Preparation of Stable Dispersions of Colloidal Gold in Hexanes by Phase Transfer," *J. of Colloid and Interface Sci.*, 1993, 161, 471-474.
Kamyshny, A. et al., "Ink-Jet Printing of Mettalic Nanoparticles and Microemulsions," *Macromolecular Rapid Communications*, 2005, 26, 281-288.
Kaydanova, T. et al., "Direct-Write Contacts for Solar Cells," Conf. paper NREL/CP-520-37080, *2004 DOE Solar Energy Technologies Program Review Meeting*, Jan. 2005, 4 pages.
Kaydanova, T. et al., "Ink Jet Printing Approaches to Solar Cell Contacts," Conf. Paper NREL/CP-520-33594, *National Center for Photovoltaics and Solar Program Review Meeting*, May 2003, 6 pages.
Kourtakis, K. et al., "A Novel Synthetic Method for the Preparation of Oxide Superconductors: Anionic Oxidation-Reduction," *J. Solid State Chem.*, 1989, 82, 290-297.
Kourtakis, K. et al., "Synthesis of $Ba_2YCu_4O_8$ by anionic oxidation-reduction," *J. Mater. Res.*, 1989, 4(6), 1289-1291.
Kourtakis, K. et al., "Synthesis of $Ba_2YCu_3O_7$ by the SCD Method Using Amino Acid Salt Reducing Agents," *J. Solid State Chem.*, 1990, 84, 88-92.
Kourtakis, K. et al., "Synthesis of $Ba_2YCu_3O_7$ Powder by Anionic Oxidation," *J. Solid State Chem.*, 1989, 83, 230-236.
Lee, et al., "Direct synthesis and bonding origins of monolayer-protected silver nanocrystals from silver nitrate through in-situ ligand exchange," *J. of Colloid and Interface Sci*, 2006, 304, 92-97.
Lee, K. J. et al., "Direct Synthesis and inkjetting of silver nanocrystals toward printed electronics," *Nanotechnology*, 2006, 17, 2424-2428.
Li, Y., et al., "Size Effects of Pvp-Pd Nanoparticles on the Catalytic Suzuki Reactions in Aqueous Solution," *Langmuir*, 2002, 18, 4921.
Manshausen, P., "Role and Function of Rheological Additives in Modern Emulsion and Industrial Coatings," Borchers GmbH, Monheim, Germany, *Presented at the 6th Nurnberg Congress*, Apr. 2001, 8 pages.
Mezger, T.G., *The Rheology Handbook*, 2002, published by Vincentz Verlag, Hannover, Germany, pp. 138-144.
Porter, Jr., L. A. et al., "Gold and Silver Nanoparticles Functionalized by the Adsorption of Dialkyl Disulfides," *Langmuir*, 1998, 14, 7378-7386.
Reed-Hill, R. E., *Physical Metallurgy Principles*, McGraw-Hill Book Company, Publishing, p. 311.
Richardson, J. T., *Principles of Catalyst Development*, Plenum Press, New York, NY, 1989, p. 29.
Sumitomo Metal Mining Co., Ltd. (Japan), "Conductive paint (Silver-colloidal Paste) for electrode formation / Under development," © 2001, available online at <URL:http:www.smm.co.jp/b_info_E/b10_E.html>.
Taleb, A., et al., "Synthesis of Highly Monodisperse Silver Nanoparticles from AOT Reverse Micelles: A Way to 2D and 3D Self-Organization," *Chem. Mat.*, 1997, 9, 950-959.
Trimm, D. L., *Design of Industrial Catalysts*, Elsevier Scientific Publishing Co., Amsterdam, 1980, p. 107.
Verstrat, D.W., Research Report, "Formulating with Associative Rheology Modifiers", Alco Chemical website, accessed on Jan. 26, 2007, <URLwww.alcochemical.com>, Alco Chemical Company, Division of National Starch and Chemical Company, Chattanooga, TN.
Wang, W. et al., "Directing Silver nanoparticle into colloid-surfactant lyotropic lamellar systems," *J. of Physical Chem. B.*, 1999, 103(27), 5613-5621.
Wang, W. et al., "Directing Oleate Stabilized Nanosized Silver Colloids into Organic Phases," *Langmuir*, 1998, 14, 602-610.
Wang, W. et al., "Silver Nanoparticles Capped by Long-Chain Unsaturated Carboxylates," *J. Phys. Chem. B*, 1999, 103, 7238-7246.
Yamamoto, M., et al., New Type of Monodispersed Gold Nanoparticles Capped by Myristate and PPh3 Ligands Prepared by Controlled Thermolysis of $[Au(C_{13}H_{27}COO)(PPh_3)]$ *Chem. Letters*, 2003, 32(5), 452-453.
Yamamoto, M., et al., "Size-Controlled Synthesis of Monodispersed Silver Nanoparticles Capped by Long-Chain Alkyl Carboxylates from Silver Carboxylate and Tertiary Amine," *Langmuir*, 2006, 22, 8581-8586.
Yi, K.C. et al., "Chemical Formation of Silver Particulate Films under Monolayers," *J. Phys. Chem. B.*, 1994, 98, 3872-3881.
Yonezawa, T. et al., "Preparation of Highly Positively Charged Silver Nanoballs and Their Stability," *Langmuir*, 2000, 16, 5218-5220.
Young, V.L. and Hickman, A.D., "Efficiency of Various Thickener Types, Natural and Synthetic, as Viscosity Builders in Paper Coating Formulations," Dec. 1995, *Dow Latex Technotes*, Jan. 6, 1992, 4 pages.
Fuller, S.B. et al., "Ink-Jet Printed Nanoparticle Microelectromechanical Systems," Journal of Microelectromechanical Systems, 11(1), Feb. 2002, 54-60.
Kataby, G. et al., "Coating Carboxylic Acids on Amorphous Iron Nanoparticles," Langmuir, Feb. 3, 1999, 15, 1703-1708.
Komarneni, S. et al., "Microwave-polyol process for metal nanophases," Journal of Physics: Condensed Matter, 2004, 16, S1305-S1312.
Shi, W. et al., "Gold nanoparticles surface-terminated with bifunctional ligands," Colloids and Surfaces A: Physiochem. Eng. Aspects, 2004, 246, 109-113.
Worden, J.G. et al., "Monofunctional Group-Modified Gold Nanoparticles from Solid Phase Synthesis Approach: Solid Support and Experimental Condition Effect," Chemical Materials, 2004, 16, 3746-3755.
Yonezawa, T. et al., "Practical preparation of anionic mercapto ligand-stabilized gold nanoparticles and their immobilization," Colloids and Surfaces A: Physiochemical and Engineering Aspects, 149, 1999, 193-199.

* cited by examiner

SYNTHESIS OF METALLIC NANOPARTICLE DISPERSIONS CAPABLE OF SINTERING AT LOW TEMPERATURES

CROSS-REFERENCE TO RELATED APPLICATION

The present application claims the benefit under 35 U.S.C. §119(e) of U.S. Provisional Application No. 60/623,728 filed Oct. 29, 2004, which is hereby incorporated by reference in its entirety for all purposes.

FIELD OF THE INVENTION

The present invention relates to the solution synthesis of ligand stabilized metal nanoparticles as well as the sintering of these nanoparticles into highly conductive metallic films and traces at very low temperatures.

BACKGROUND OF THE INVENTION

The development of metal nanoparticles is an active area of research academically and commercially due to their novel properties and low temperature processability. The capability of making highly conductive traces and films at low temperatures is of enormous commercial interest to the electronics industry. The economic feasibility of making devices such as RFID tags, flexible displays based on organic light emitting polymers, and solar cells rely on the ability to economically print materials capable of obtaining high conductivity at temperatures of 100° C. or lower on inexpensive substrates. Because of their size, nanoparticles can be manipulated into smaller devices and low temperature processing (sintering) allows less expensive substrate to be used. However, metallic nanoparticles are inherently unstable due to their size and activity. The particles tend to irreversibly agglomerate in both dry and dispersed states. Methods to produce large quantities of metallic nanoparticles are disclosed.

SUMMARY OF THE INVENTION

A process is described for the synthesis of metallic nanoparticles by chemical reduction of metal salts in the presence of organic ligands capable of binding to the metal particle surfaces and stabilizing them against agglomeration. The resultant nanoparticles or dispersions of the particles can be sintered into highly conductive films or traces at temperatures as low as 80° C. in 10 minutes or less.

DETAILED DESCRIPTION OF THE INVENTION

The process involves the chemical reduction of metal salt in the presence of a ligand capable of complexing or bonding to the metal in a dispersing medium. The metal salt can be solvated by the solvent or dispersed in the solvent as a solid if the salt is insoluble in the solvent phase. Preferably, the solvent is an aqueous solvent substantially free of organic solvents. However, a polar organic solvent may be used, if the metal salt can be solvated in a sufficiently high concentration, e.g., preferably about or greater, more preferably about or greater, and most preferably about 0.5 M or greater. The metal may include Ag, Cu, Pd, or alloys of these metals. The salt anion may include nitrates, carboxylates, sulfates, or chlorides. The reducing agent must be of sufficient electrochemical potential and concentration to effectively reduce the respective metal salt. A strong reducing agent which results in no undesirable ionic byproducts such as hydrazine, hydrazine hydrate, or hydrogen is preferred over other strong reducing agents such as sodium borohydride which result in ionic byproducts. Other reducing agents may be used provided that the resulting composition is substantially free of ionic byproducts.

The ligand is chosen based on its ability to complex with the metal particles and stabilize the particles once formed. Of primary interest is the ability of the ligand to allow the particles to consolidate and sinter during drying and thermal treatment. The temperature at which the particles sinter is largely controlled by the ligand adsorbed to the metal. The ligand will generally bond to the metal through a heteroatom such as oxygen, sulfur, or nitrogen present as a carboxyl, sulfonyl, thiol, etc. portion of the compound. Depending on the relative thermal stability of the complexing portion and aliphatic backbone of the ligand compound an intermediate salt may result during thermal treatment, adversely affecting the sintering of the metal nanoparticles. Ligands having a straight-chain aliphatic backbone with 3 to 20 carbon atoms are preferred. Branched or cyclic backbones having up to 20 carbon atoms may be used, if the ligand is sufficiently stable in the solvent system, i.e., the ligand does not readily precipitate and can remain solvated at a sufficiently high concentration. More preferably, ligands having 5 to 12 carbon atom backbones are used.

In the present invention, no post-synthesis treatment such as washing or phase transfer is performed in order to remove residual byproducts such as the metal salt anion. The byproducts of the reaction are purposely left in the nanoparticle mixtures to catalyze the decomposition of the ligands on the nanoparticles surface. In particular, nitrate anions can react with organic acid ligands in self-propagating chemical decomposition or anionic oxidation-reduction synthesis of superconducting oxides to prevent intermediate metal salts. Alternatively, a compound such as an amine could be added to the reaction product or be part of the ligand molecule which similarly catalyzes the decomposition of the ligands and sintering of the nanoparticles. The particles are sometimes allowed to settle in order to concentrate them for forming films.

While not being bound by a particular theory, it is believed that the particles are able to remain dispersed in the aqueous phase by the formation of interdigitated bi-layers of the ligand or vesicle structures around the particles. The particles are stabilized by ligands binding to the surface of the silver through nucleophilic head groups with the aliphatic portion extending outward. The aliphatic portion of ligands not bound to the silver surface associate with the aliphatic portion of the bound ligands forming a vesicle around the silver. If no bi-layer formed then the particles should want to phase separate into an oily phase, so it is believed that the ligands are forming a bi-layer around the particles. The bi-layer can be broken down causing the silver particles to form an hydrophobic phase by either changing the pH or adding a salt to the aqueous sol.

Example 1

The initial solution was prepared by adding 7.5 grams of ammonium hydroxide (30% ammonia by weight) to 275 grams of water; 13.5 grams of heptanoic acid was added to this solution followed by 20.9 grams of 50% hydrazine hydrate aqueous solution. The ammonium hydroxide is necessary to allow the acid to dissolve in the water. Separately, 36 grams of silver nitrate was dissolved in 175 grams of water. The silver nitrate solution was added to the initial solution while stirring under nitrogen. The resultant product was flocculated and allowed to settle. Excess water was decanted off. The concentrated product was spread onto 5 mil polyester film with a 0.5 mil wire wound rod and then cured at 80 and 100° C. for 1-2 minutes resulting in cohesive and conductive silver films.

Example 2

The material of example one was transferred to hexane by sodium chloride induction similar to the method of Hirai [7-8]. Hexane and a sodium chloride solution was added to concentrated material from Example 1 and the two phases mixed with a magnetic stir bar for 10 minutes. The silver nanoparticles transferred phases to the non-aqueous phase presumably leaving all ionic species in the aqueous phase. The solvent phase with the suspended silver particles was separated from the water phase. When an attempt was made to cure the phase transferred material at 120° C., the silver did not cure and an oily silver film remained even after extended periods at this temperature.

Example 3

The initial solution was prepared by adding 2.1 grams of ammonium hydroxide (30% ammonia by weight) to 50 grams of water; 7.8 grams of heptanoic acid was added to this solution followed by 3 grams of 50% hydrazine hydrate aqueous solution. Separately, 10 grams of silver nitrate was dissolved in 50 grams of water. The silver nitrate solution was added to the initial solution while stirring under nitrogen. The resultant product was allowed to settle and the excess water decanted off. The concentrated product was spread onto 5 mil polyester film with a 0.5 mil wire wound rod and then cured at 80 and 100° C. for 1-2 minutes resulting in cohesive and conductive silver films. The weight resistivity of a sample cured at 100° C. for 1 minute was measured to be 0.39 $g\Omega/m^2$ (~2× bulk silver).

REFERENCES

1. K. Kourtakis, M. Robbins, and P. K. Gallagher, *J. Solid State Chem.* 82, 290-297 (1989).
2. K. Kourtakis, M. Robbins, and P. K. Gallagher, *J. Solid State Chem.* 83, 230-236 (1989).
3. K. Kourtakis, M. Robbins, P. K. Gallagher, and T. Tiefel, *J. Mater. Res.* 4[6], 1289-1291 (1989).
4. K. Kourtakis, M. Robbins, and P. K. Gallagher, *J. Solid State Chem.* 84, 88-92 (1989).
5. W. Wang, S. Efrima, O. Regev, *J. of Physical Chem. B,* 103[27], 5613-5621 (1999).
6. W. Wang, S. Efrima, O. Regev, *Langmuir,* 14, 602-610 (1997).
7. H. Hirai, H. Aizawa, and H. Shiozaki, *Chemistry Letters,* 1527-1530 (1992).
8. H. Hirai and H. Aizawa, *J. of Colloid and Interface Sci.,* 161, 471-474 (1993).

Although there has been hereinabove described method of synthesizing metallic nanoparticles, the products thereof and forming a metallic film therefrom, in accordance with the present invention, for the purposes of illustrating the manner in which the invention may be used to advantage, it should be appreciated that the invention is not limited thereto. Accordingly, any and all modifications, variations, or equivalent arrangements which may occur to one skilled in the art should be considered to be within the scope of the present invention as defined in the appended claims.

What is claimed is:

1. A method of synthesizing a metallic nanoparticle composition, comprising:

dissolving silver nitrate in water and combining the dissolved silver nitrate with an admixture comprising water, a base, a carboxylic acid including from 3 to 7 carbons, and a reducing agent, so as to give rise to one or more metallic nanoparticles comprising silver.

2. The method of claim 1, wherein the reducing agent comprises hydrazine.

3. The method of claim 1, wherein the carboxylic acid comprises heptanoic acid.

4. The method of claim 1, wherein the base comprises ammonium hydroxide.

5. The method of claim 1, wherein the weight ratio of silver nitrate to water in the second admixture is about 1:5.

6. The method of claim 1, wherein the dissolved silver nitrate and the admixture are combined under nitrogen.

7. The method of claim 1, wherein the metallic nanoparticles are capable of sintering together when cured at 100° C. for from about 1 to about 2 minutes.

8. The method of claim 1, wherein the metallic nanoparticles are capable of sintering together when cured at 80° C. for from about 1 to about 2 minutes.

9. A method of forming a conductive cohesive film on a substrate, comprising:

depositing a metallic nanoparticle composition comprising silver; and curing the composition so as to form a conductive, cohesive film comprising a plurality of sintered metallic nanoparticles, wherein the nanoparticle composition is made by dissolving silver nitrate in water and combining the dissolved silver nitrate with an admixture comprising water, a base, a carboxylic acid including from 3 to 7 carbons, and a reducing agent, second so as to give rise to one or more metallic nanoparticles comprising silver.

10. The method of claim 9, wherein the conductive cohesive film has a bulk resistivity of about twice that of bulk silver.

11. The method of claim 10, wherein the curing takes place at least about 80° C.

12. The method of claim 9, wherein the reducing agent comprises hydrazine.

13. The method of claim 9, wherein the carboxylic acid comprises heptanoic acid.

14. The method of claim 9, wherein the base comprises ammonium hydroxide.

15. The method of claim 9, wherein the weight ratio of silver nitrate to water in the second admixture is about 1:5.

16. The method of claim 9, wherein the dissolved silver nitrate and the admixture are combined under nitrogen.

17. The method of claim 9, wherein the curing takes place at least about 80° C.

* * * * *